United States Patent [19]

Finucane et al.

[11] Patent Number: 4,523,879

[45] Date of Patent: Jun. 18, 1985

[54] ICE BARRIER CONSTRUCTION

[75] Inventors: Raymond G. Finucane; Hans O. Jahns, both of Houston, Tex.

[73] Assignee: Exxon Production Research Co., Houston, Tex.

[21] Appl. No.: 369,042

[22] Filed: Apr. 16, 1982

[51] Int. Cl.[3] ..... E02D 21/00; E02B 17/00

[52] U.S. Cl. ..... 405/217; 62/260; 405/60; 405/195

[58] Field of Search ..... 405/52, 60, 61, 211, 405/217; 62/259, 260

[56] References Cited

U.S. PATENT DOCUMENTS

| | | | |
|---|---|---|---|
| 3,129,565 | 4/1964 | Bellamy | 405/61 |
| 3,863,456 | 2/1975 | Durning | 405/217 |
| 3,881,318 | 5/1975 | Galloway | 405/61 |
| 4,048,808 | 9/1977 | Duthweiler | 405/217 |
| 4,192,630 | 3/1980 | Duthweiler | 405/217 |
| 4,245,930 | 1/1981 | Gefvert | 405/60 |
| 4,326,822 | 4/1982 | Oshima | 405/217 |

FOREIGN PATENT DOCUMENTS

| | | | |
|---|---|---|---|
| 972975 | 8/1975 | Canada | 405/217 |
| 2467915 | 5/1981 | France | 405/60 |

OTHER PUBLICATIONS

"Heat and Mass Transfer from Freely Falling Drops at Low Temperatures", by the United States Army Corps of Engineers Cold Regions Research and Engineering Laboratory (Report 80-18, Aug. 1980).

"Artificial Massifs of Ice in the Arctic Seas" by P. I. Melnokov et al. Submitted for Presentation at the Fourth International Conference on Permafrost, Fairbanks, Ak., Jul. 18-22, 1983.

*Primary Examiner*—Dennis L. Taylor

*Attorney, Agent, or Firm*—Kenneth C. Johnson

[57] ABSTRACT

A method is provided for constructing spray ice barriers to protect offshore structures in a frigid body of water from mobile ice, waves and currents. Water is withdrawn from the body of water and is sprayed through ambient air which is below the freezing temperature of the water so that a substantial amount of the water freezes as it passes through the air. The sprayed water is directed to build up a mass of ice having a size and shape adapted to protect the offshore structure. Spray ice barriers can also be constructed for the containment of pollutant spills.

28 Claims, 13 Drawing Figures

FIG. 5
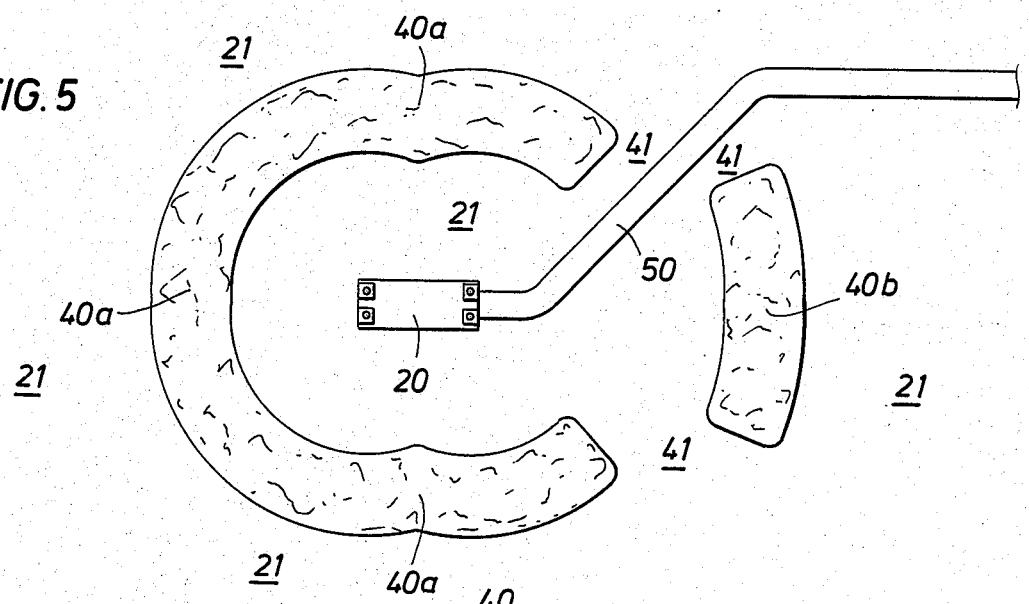
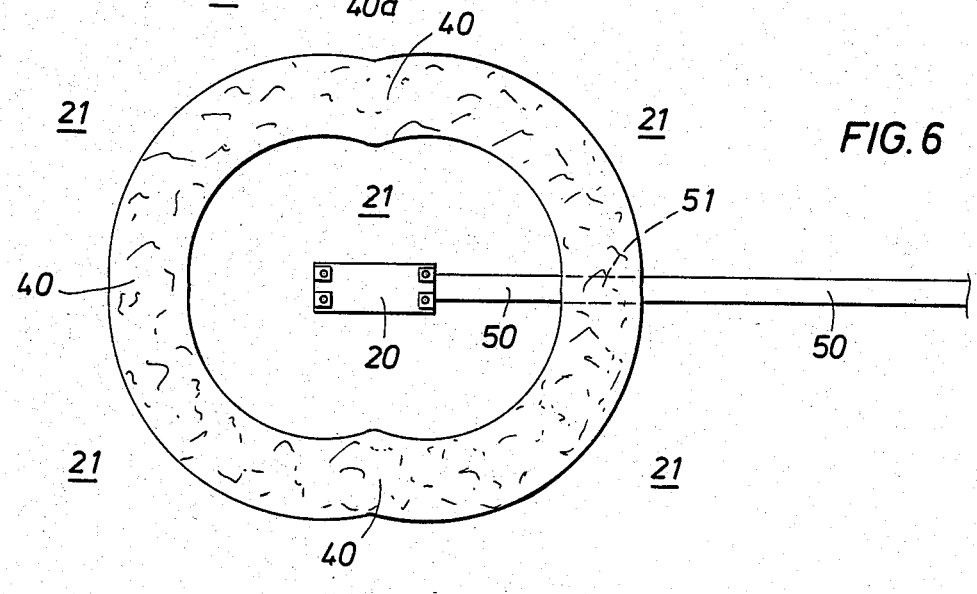
FIG. 6
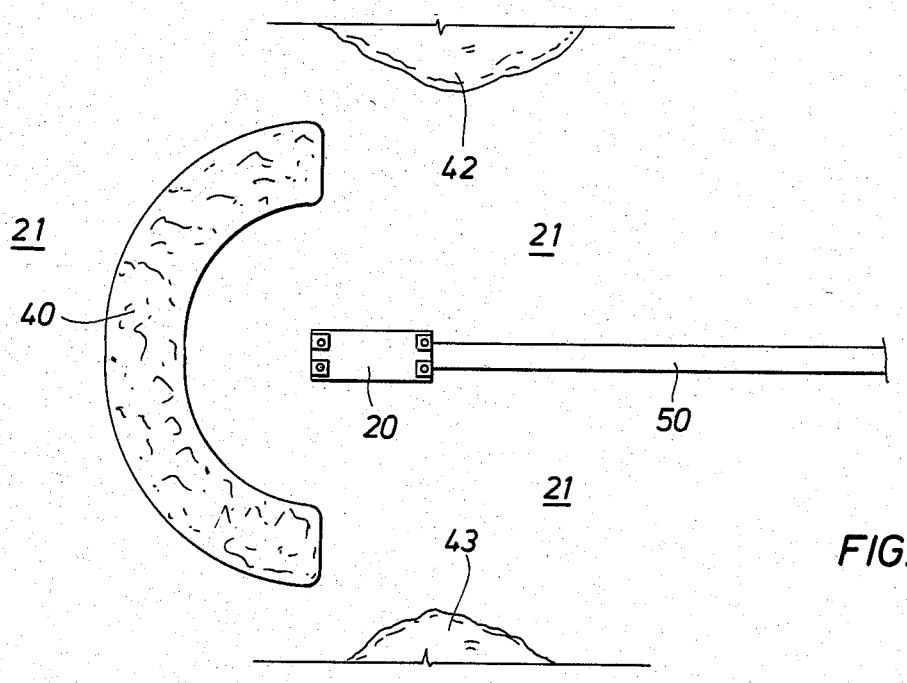
FIG. 7

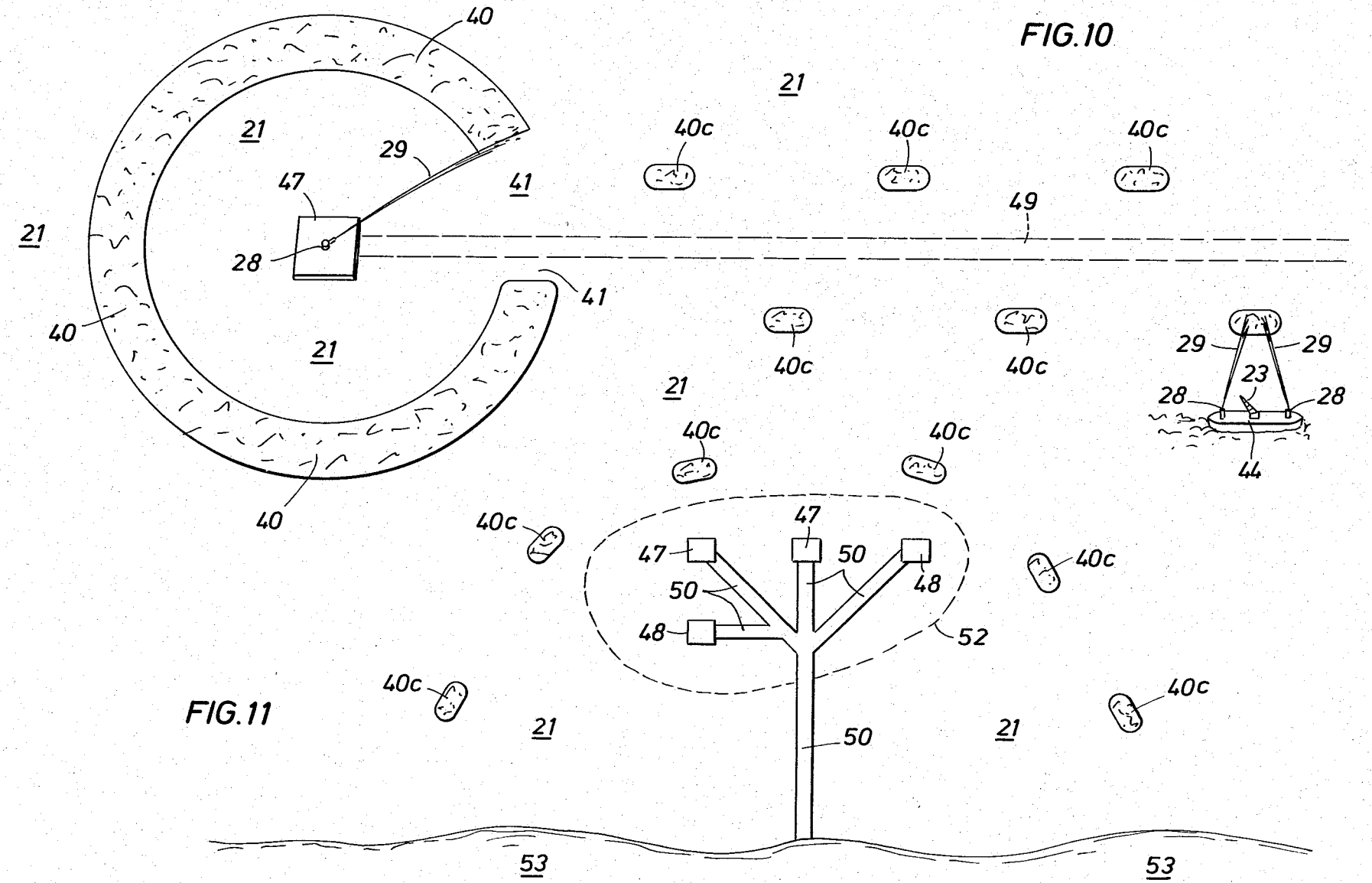
29
28
23
44
29
28
40c
40c
40c

ICE BARRIER CONSTRUCTION

BACKGROUND OF THE INVENTION

1. Field of the Invention

The present invention relates to the construction of barriers in frigid offshore environments. More particularly, the present invention relates to the construction of ice barriers for the protection of offshore structures such as drilling barges, offshore platforms, man-made islands, ice roads and wellheads, and for the containment of pollutant spills.

2. Description of the Prior Art

The search for new sources of petroleum has led man in recent years to frigid offshore environments where large bodies of moving ice are found. These large moving bodies of ice can damage offshore structures such as drilling barges, offshore platforms and underwater pipelines which lie in their path.

An example of such an area is off the north coast of Alaska in the Beaufort Sea. With the onset of winter, the sea water near the coastline begins to freeze over. This results in the formation of a relatively smooth and continuous sheet of ice called fast ice which extends seaward from the shore to points which lie over water approximately 60 feet deep. The name fast ice implies that this sheet of ice is held fast to the land and does not move. However, fast ice can be moved by natural forces such as currents, tides and temperature changes, with the rate of movement being generally dependent on the thickness of the ice.

When set into motion, fast ice poses a threat to offshore operations. When the ice comes into contact with an offshore structure such as a drilling platform, large compressive forces develop. These forces cause the ice sheet to break and pile up against the offshore structure, forming a rubble field. As the rubble field grows and continues to be pressed against the structure, the compressive forces can increase until the structure is seriously damaged or pushed off location.

Although it is subject to movement, fast ice is relatively stable during the winter. However, the fast ice sheet breaks up during the summer, resulting in the formation of many individual floating bodies of ice which are free to move about under the influence of the winds and currents. These moving bodies of ice pose another threat to offshore operations.

Seaward from the fast ice zone is pack ice. Unlike fast ice, pack ice is discontinuous, rugged and highly mobile. As pack ice moves, local areas of tension and compression develop, causing the ice to break and to pile up. As a result, open leads and pressure ridges are formed.

Pressure ridges form in areas of pack ice which experience large compressive forces. The ice breaks and piles up, concentrating large masses of ice into relatively small areas. Pressure ridges extend well above and below the surrounding ice, and some are so large that they are able to survive the summer and become multiyear ice features.

During the winter season, many pressure ridges are embedded in the pack ice and move along with it, threatening any structures in their path. During the summer, pressure ridges can be blown toward shore where they threaten structures which lie in shallow waters. Other moving bodies of ice such as glacial icebergs and floebergs also pose a serious threat to offshore operations.

Many approaches have been suggested for protecting offshore structures from large moving bodies of ice. For example, U.S. Pat. No. 3,436,920 (Blenkarn et al) discloses the use of a fence-like barrier which is erected around an offshore structure. Methods such as this have serious drawbacks due to the time and expense involved. Materials have to be obtained, and their lack of availability in arctic regions usually means they have to be transported great distances. The structures must then be built, placed in position and anchored to the sea floor.

U.S. Pat. No. 4,048,808 (Duthweiler) avoids some of the drawbacks associated with the use of barriers which must be assembled from materials not readily available. It calls for the use of ice made from the surrounding water as the fabrication material for a containment barrier which surrounds a man-made ice island. This barrier is designed to contain oilspills which may accidentally result from drilling operations conducted from the ice island. Dikes defining confined areas on the naturally occurring ice sheet are first constructed. These confined areas are then flooded to a depth of about four inches, and the water is allowed to freeze. More layers of ice are made by the same flooding process until a sufficient mass has been built up to displace the ice sheet downward and ground it against the bottom of the sea, thereby forming a containment barrier.

This approach also has its drawbacks. Dikes must be erected, and the rate of barrier construction is relatively slow, as disclosed in the example given in the patent which calls for the formation of a 12 foot high barrier in 59 days. To this must be added the time required before the naturally occurring ice shet becomes thick enough to support the dike-building and water-flooding equipment.

Time is a crucial element in arctic operations. The per diem operational expenses are exceedingly high, and restrictions may limit drilling operations to a few months of the year. With a far more rapid method of construction, larger and stronger barriers could be built in less time and at a smaller expense, making it feasible to construct barriers in deep waters where oil and gas may be found.

A means is still needed for protecting offshore structures from moving bodies of ice and other natural forces in a manner which is both fast and economical.

SUMMARY OF THE INVENTION

Briefly, the present invention involves means for protecting offshore structures located in frigid waters from moving ice and other natural forces such as waves and currents. A spray ice barrier is constructed which has its base grounded against the sea floor and its top extending above the water's surface. The spray ice barrier is constructed by accumulating ice which is formed by pumping water from the sea and spraying it through ambient air which is below the freezing temperature of the water. A substantial amount of the water freezes as it passes through the air, and falls as ice to build up the spray ice barrier. If the spray ice barrier is constructed in open water or in water covered by a very thin ice sheet, the ice which is initially accumulated will form the base of the spray ice barrier. If the spray ice barrier is constructed at a location where a relatively thick ice sheet exists, then the area of the ice sheet onto which the ice is accumulated will form the base. As more and more water is sprayed and ice accumulates, the base is displaced downward until it grounds against the sea floor. The spraying is continued until the spray ice barrier becomes massive enough to resist the natural forces from which protection is needed. Spray ice barriers can also serve as containment barriers for the containment of pollutant spills.

Spray monitors adapted for use in a frigid environment and having a high output rate can be used to construct the spray ice barriers. The spray monitors can pivot horizontally and vertically so that they can be aimed over a wide range of directions. This makes it possible to rapidly construct spray ice barriers having a variety of shapes. The spray monitors can be mounted on the structure for which protection is desired, or they can be mounted on a support vessel such as an icebreaker or on a support vehicle such as a truck.

BRIEF DESCRIPTION OF THE DRAWINGS

FIG. 5 is a plan view of a spray ice barrier which consists of two sections and protects a drilling barge on all sides.

FIG. 6 is a plan view of a 360° spray ice barrier.

FIG. 7 is a plan view of a 180° spray ice barrier.

FIG. 10 is a perspective view which shows an icebreaker equipped with spray monitors in the process of constructing one of a number of discontinuous spray ice barriers for the protection of an ice road.

FIG. 11 is a plan view of an offshore oil field with production and drilling platforms which are protected by a number of discontinuous spray ice barriers constructed on the exposed seaward side of the oil field.

DESCRIPTION OF THE PREFERRED EMBODIMENTS

The Spray Ice Barrier Construction Method

The present invention involves the construction of spray ice barriers designed to protect offshore structures from moving bodies of ice and other natural forces such as waves and currents. Spray ice barriers can also be used to contain pollutant spills. The details of the present invention will be described below. In general, a spray ice barrier which has its base grounded against the sea floor and its top extending above the surface of the water is constructed around an offshore structure located in a frigid body of water containing either fresh or salt water. The spray ice barrier is constructed by pumping water from the body of water and spraying it through ambient air which is below the freezing temperature of the water. The water freezes as it passes through the air and falls to a desired target area where the spray ice barrier is built up by accumulating ice in this manner. The ice which is initially accumulated forms the base of the spray ice barrier. The continued accumulation of ice builds up a mass which displaces the base of the spray ice barrier downward until it grounds against the sea floor. The spraying is continued until a barrier of the desired size and shape has been constructed.

Figure 1:
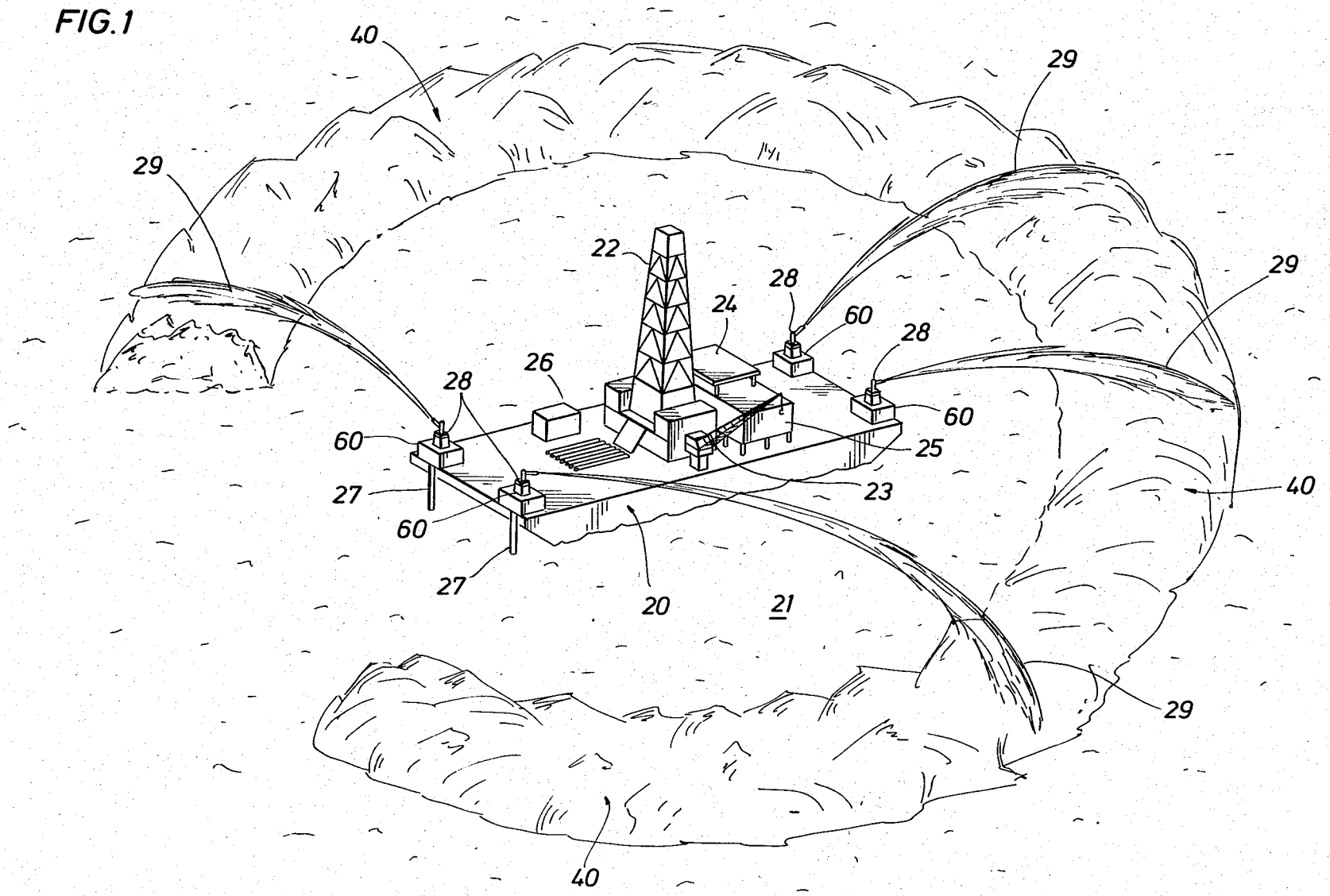
FIG. 1 is a perspective view showing a drilling barge equipped with spray monitors in the process of constructing a spray ice barrier.

Referring to FIG. 1, the spray ice barrier construction method of the present invention can be seen. Drilling barge 20 is positioned at a desired offshore drilling location which is covered by ice sheet 21 and is in the process of constructing spray ice barrier 40. The drilling barge has equipment normally associated with offshore drilling operations such as derrick 22, crane 23, helicopter pad 24 and crew quarters 25.

Generators 26 are located on the deck of the drilling barge. These generators supply electricity for pumping water which is drawn from the sea through suction lines 27 and sprayed from four spray monitors 28, each positioned at a corner of the drilling barge. Spray monitors are water cannons which are adapted to pivot for aiming purposes. Spray monitors 28 are adapted to pivot both vertically and horizontally and to deliver water streams 29 across long distances. The vertical and horizontal pivoting capability permits the construction of spray ice barriers having a variety of shapes at an optimum distance from the drilling barge. The design and operation of the spray monitors will be described in detail later.

The ambient air is below the freezing temperature of the water being sprayed, so a substantial amount of the water freezes as it passes through the air. The ice thus formed falls onto a target area of the ice sheet upon which the spray ice barrier is constructed. Ice is accumulated in this manner to build up a mass of ice which is displaced downward until it grounds against the sea floor. The spraying is continued until the spray ice barrier becomes large enough to provide protection against any moving bodies of ice which would otherwise encroach on the drilling barge.

Prior to commencing the spray ice barrier construction, the drilling barge is moved to the desired drilling location. The drilling barge can be towed or pushed by a vessel (not shown) to the desired drilling location before the area freezes over with ice sheet 21. The drilling barge is then anchored into position and suction lines 27 are lowered into the water. The spray ice barrier construction process is commenced as soon as practical after the ice sheet has begun to form.

Alternatively, a drilling barge can be towed or pushed by an icebreaker (not shown) to the desired location after the ice sheet has already formed. Once the drilling barge is positioned and anchored, suction lines are lowered into the water through openings in the ice sheet caused by the passing of the icebreaker and drilling barge. If necessary, holes can be cut through the ice sheet to accommodate the suction lines. Once the suction lines are in place, the spray ice barrier construction process is begun.

A target area of the ice sheet which has dimensions roughly corresponding to the base dimensions of the desired spray ice barrier is selected. Water is then sprayed from spray monitors 28 through the frigid air so that ice is formed and falls onto the target area. The accumulating mass of ice causes the target area of the ice sheet to break away from the surrounding area of the ice sheet. If the naturally occurring ice sheet is thick, the target area of the ice sheet will form the base of the spray ice barrier. If the ice sheet is thin, the ice which is initially accumulated will form the base. The base of the spray ice barrier is displaced downward under the weight of the accumulating ice until it grounds against the sea floor.

If the sea is calm and cold enough at the desired location, it might not be necessary to wait for an ice sheet to form over the water. The spray ice barrier could be constructed by directing the water streams from the spray monitors so that ice will fall onto an open-water target area. In this case, the ice which is initially accumulated will form the base of the spray ice barrier. This base is displaced downward by the accumulating ice until it grounds against the sea floor.

Figure 2:
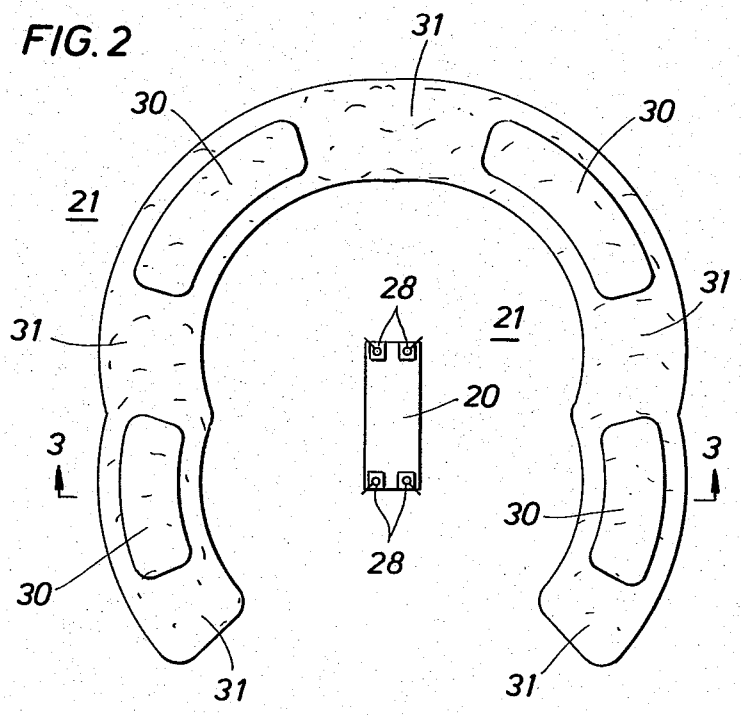
FIG. 2 is a plan view of a two-phase spray ice barrier construction process.

Typically, the spray ice barrier construction process would take place in two phases. Referring to FIG. 2, a plan view of a two-phase construction process can be seen. The first phase of the construction process is the local stabilization phase. The output of each spray monitor is directed at a local stabilization target area of ice sheet 21. The four local stabilization target areas 30 cover an area of the ice sheet which is smaller than the area upon which the entire spray ice barrier will ultimately be constructed. The object of the local stabilization phase is to rapidly ground local areas of the ice sheet in order to prevent possible movement of the ice sheet during the main construction phase. As the ice accumulates, the ice sheet will break and the local stabilization target areas of the ice sheet will be displaced downward until they ground against the sea floor.

At this point, the main construction phase is begun. During the main construction phase, the spray monitors are oscillated back and forth in the horizontal plane so that their combined output will cover elongated target area 31 of the ice sheet. The dimensions of this target area are roughly equal to the desired base dimensions of the spray ice barrier being constructed. As the ice accumulates on the target area, the target area of the ice sheet breaks away from the surrounding area of the ice sheet and is displaced downward until it grounds against the sea floor. The spraying is continued until a spray ice barrier has been constructed having a size and shape adapted to protect the drilling barge by blocking mobile ice.

Figure 3:
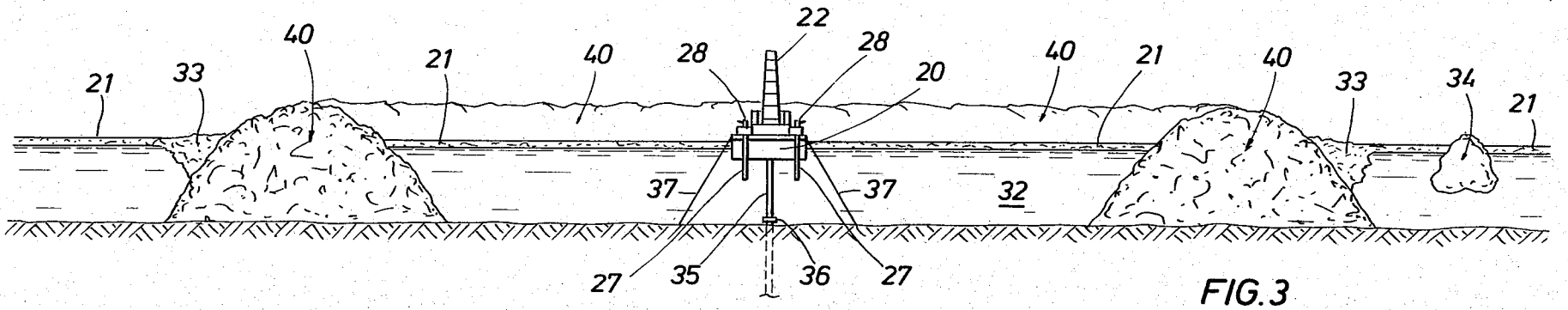
FIG. 3 is a sectional view of a spray ice barrier taken along line 3—3 of FIG. 2.

Referring to FIG. 3, a cross section of a completed spray ice barrier of the present invention taken along line 3—3 of FIG. 2 can be seen. Spray ice barrier 40 forms protected lagoon 32 where drilling operations can be conducted in a relatively benign environment. Encroaching ice is stopped by the spray ice barrier, and currents which would otherwise interfere with drilling operations are prevented from entering the lagoon.

The protection afforded against encroaching ice can be seen where ice sheet 21 is being pressed against the spray ice barrier. The resulting compressive forces have broken the ice sheet, causing rubble field 33 to form on the outside of the barrier, posing no threat to the drilling operations within. Very large moving bodies of ice such as pressure ridge 34 will also be stopped by the spray ice barrier. Without this protection, drilling barge 20 and underwater equipment such as riser pipe 35, blowout preventer 36 and anchor lines 37 could suffer damage from the moving ice. The portion of the spray ice barrier which extends above the surface of the ice sheet also helps to block the severe winds and drifting snow which are characteristic of arctic regions in the winter.

Spray ice barriers can be constructed by the method of the present invention in a very rapid fashion. By reducing the time required for barrier construction, offshore operations requiring protection can get underway much sooner. Since the per diem costs for offshore arctic operations are exceedingly high, this results in great savings. The economic advantages of the present invention are even more pronounced when compared to prior art protective measures requiring the purchase and transportation of barrier fabrication materials.

In addition to the economic advantages, the rapid construction method of the present invention makes it possible to construct ice barriers in relatively deep waters. For example, a spray ice barrier could be constructed in water 45 feet deep off the north coast of Alaska in about 25 days, as follows. In early November when the sea ice is 1 to 2 feet thick, a drilling barge equipped with spray monitors is towed by an icebreaker to the desired drilling location. The icebreaker assists in anchoring the drilling barge into position and then departs. Suction lines which supply water to the spray monitors are extended into the water. Pumps are turned on, and the spraying operation is commenced. Each of the spray monitors sprays 10,000 gallons of water per minute through the frigid ambient air.

During the local stabilization phase, the output of each spray monitor is directed at a limited local stabilization target area. Ice formed by the passage of the water through the air accumulates on each of these target areas at a rate of about 10 to 30 vertical feet per day. The local stabilization spraying is continued for about 3 to 5 days, at which time the local stabilization target areas of the ice sheet become grounded against the sea floor. The main construction phase is then begun.

The main construction phase lasts for about 20 days. During this time, the spray monitors are oscillated to construct a spray ice barrier which is grounded against the sea floor and which substantially surrounds the drilling barge. As seen in FIGS. 1 and 2, the completed spray ice barrier is roughly annular in shape with an opening at one end. As its base, the spray ice barrier has an inner diameter of about 600 feet and an outer diameter of about 1200 feet. The spray ice barrier tapers upward to a height of about 75 to 100 feet from its base which is about 300 feet wide. The shape of the spray ice barrier may be irregular due to winds which vary during construction. The mass of the completed spray ice barrier is about 1 to 5 million tons. This enormous mass of ice will effectively protect the drilling barge from encroaching sea ice, and drilling operations can be safely carried out.

The spray monitors used to construct the spray ice barrier are adapted to pivot vertically as well as horizontally. By adjusting the angle of elevation of the spray monitors, the barrier can be constructed out to a distance which is roughly equal to the maximum throw length of the spray monitors. Throw length is the horizontal distance measured from the spray monitor to the impact area on the ice sheet. Varying the angle of elevation of the spray monitors also changes the throw height, which is the vertical distance measured from the spray monitor to the top of the water stream arc.

Maximum throw length is achieved when a spray monitor is set at an angle of elevation which is usually somewhere between 30° and 45° above horizontal, depending on wind conditions. Increasing or decreasing the angle of elevation from this angle will decrease the throw length. If the spray ice barrier is to be constructed at a distance from the drilling barge which is less than the maximum throw length of the spray monitor, the angle of elevation can be set either above or below the angle which yields the maximum throw length. The choice will depend on the environmental conditions. For example, if the ambient air is extremely cold and the wind is at a high velocity, the lower angle of elevation would be desired. This is because the water stream will be subjected to less of the high velocity wind, thereby improving aiming accuracy, while the air is cold enough to freeze a sufficient amount of the water before it lands. On the other hand, if the ambient air is not much below the freezing temperature of the water being sprayed and the wind velocity is low, the higher angle of elevation would be preferred. This choice results in a greater throw height, thereby exposing the water stream to the air for a longer period of time to achieve maximum freezing.

The vertical pivoting capability of the spray monitors serves other purposes as well. By varying the vertical elevation of the spray monitors as they are sweeping back and forth in the horizontal direction, a very wide spray ice barrier can be built. In addition, the vertical elevation can be adjusted to help compensate for the effect of varying wind conditions.

SPRAY ICE BARRIER SHAPES

By pivoting the spray monitors horizontally and vertically, a variety of spray ice barrier shapes can be constructed. The barrier construction method of the present invention is thus well suited for a wide range of barrier applications tailored to the specific demands of the environment and the various offshore structures which need protection. FIGS. 4, 5, 6 and 7 show examples of such applications.

Figure 4:
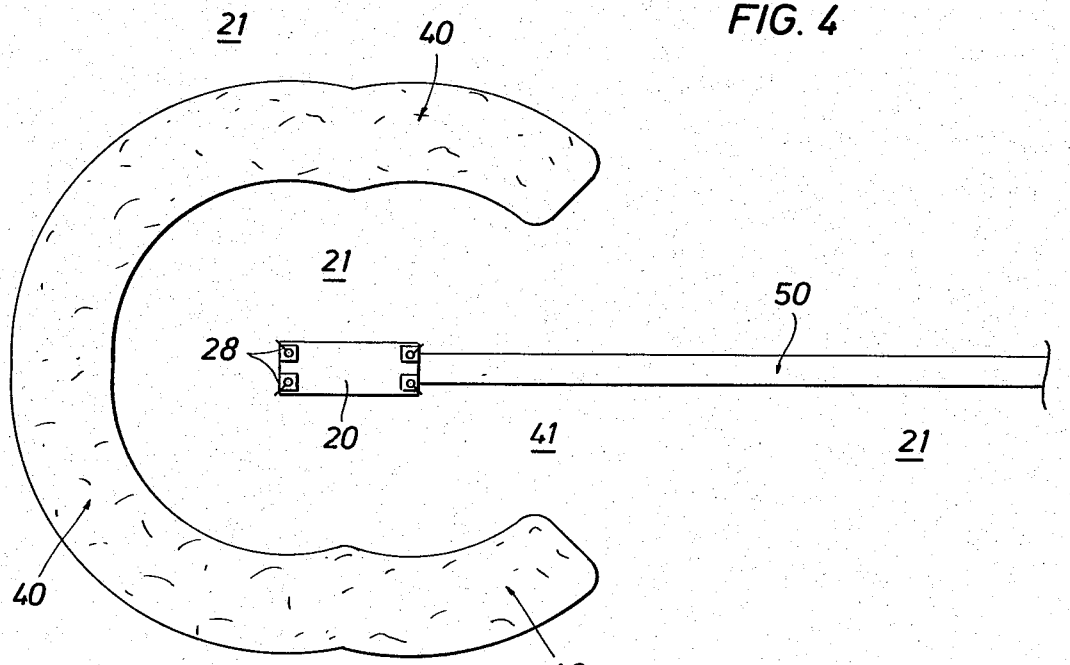
FIG. 4 is a plan view of a 270° spray ice barrier.

Referring to FIG. 4, a plan view of a 270° spray ice barrier can be seen. Ice road 50 runs from drilling barge 20 to the shore over ice sheet 21. To protect the drilling barge, spray ice barrier 40 has been constructed which extends for about 270° around the drilling barge and has its open end facing the shore. The location which has been chosen for drilling in this case is subject to ice movement from all directions except the direction facing shore. The opening in the spray ice barrier which faces the shore provides passageway 41 for the ice road and also provides a passageway for the drilling barge to be towed to another location when desired. This makes it possible for the drilling barge to drill at two or more separate locations during a single winter drilling season.

Referring to FIG. 5, a spray ice barrier can be seen which is adapted to protect drilling barge 20 from ice encroaching from any direction. This spray ice barrier consists of two discontinuous sections. Section 40*a* is a 270° spray ice barrier which protects the drilling barge from ice which encroaches from all directions except the shoreward direction. Section 40*b* has been constructed to protect the drilling barge on its shoreward side. By constructing a spray ice barrier which consists of two discontinuous sections, passageways 41 can be left for ice road 50 and to provide an exit route for the drilling barge.

If the drilling barge is to remain at one location until the summer open-water season, then a continuous 360° spray ice barrier could be constructed to protect the drilling barge on all sides. Such a spray ice barrier can be seen in FIG. 6. Ramp 51 has been placed over spray ice barrier 40 so that vehicles traveling on ice road 50 can move to and from the drilling barge to provide supplies, equipment and crew exchanges. If necessary, the section of the spray ice barrier upon which the ramp is placed can be decreased in height by plowing or compacting the ice so that the grade will not be too steep for vehicles. Helicopters could also be used to supply the drilling barge.

Referring to FIG. 7, 180° spray ice barrier 40 can be seen. A 180° spray ice barrier has been choosen because drilling barge 20 is only threatened by ice which encroaches from the seaward direction. There is not a significant threat of encroachment from the shoreward directions at this location, and the remaining two sides of the drilling barge are protected by natural islands 42 and 43.

CONTAINMENT OF POLLUTANT SPILLS

In addition to serving as protective barriers, the spray ice barriers of the present invention can also function as containment barriers in the event of a pollutant spill. In the case of the 360° spray ice barrier seen in FIG. 6, the surrounding environment should be completely protected from contamination, regardless of whether the spill occurs above the surface of the ice sheet or in the lagoon formed by the spray ice barrier. By thus containing the spill, cleanup operations can be successfully undertaken using pumps and other equipment to collect the pollutants. For example, if a blowout should occur while drilling, oil should spill into the water and float upward until it contacts the ice sheet. The oil would then spread out and form an oil slick under the ice sheet which could be swept away by currents if not the the spray ice barrier. The spray ice barrier, in addition to containing the spilled oil, stabilizes the ice sheet and permits cleanup equipment to operate unaffected by ice movements which might otherwise occur.

Circumstances may call for the construction of spray ice barriers which are designed primarily for containment purposes. For example, spray monitors could be used to construct a spray ice barrier around an offshore platform in order to contain any oil spills which might accidentally occur. If constructed solely for containment purposes, the spray ice barrier would not necessarily have to be made massive enough to be grounded against the sea floor. A spray ice containment barrier could be constructed very rapidly to extend just far enough below the ice sheet to contain a floating oil slick.

With the rapid construction method of the present invention, spray ice containment barriers could even be successfully constructed around a spill which is already ongoing. Icebreaking vessels or vehicles equipped with spray monitors would travel to the site of the oil spill as quickly as possible. A spray ice containment barrier would then be rapidly constructed around the site of the spill while cleanup equipment is deployed to collect the oil.

SUMMER SURVIVABILITY

Referring again to FIG. 3, it can be seen that great quantities of naturally occurring ice can build up against the outside of the spray ice barrier during the winter season. Moving ice sheet 21, pressure ridge 34 and other moving bodies of ice will impact against the outside of the spray ice barrier and collect. The naturally occurring ice which collects in this manner forms rubble field 33 around the spray ice barrier which serves to insulate the barrier, thereby prolonging its life. Even without this natural ice buildup, the enormous mass of the spray ice barrier will enable it to survive long into the summer. The spray ice barrier will thus protect drilling barge 20 from the many free-floating bodies of ice which will result when the ice sheet breaks up.

If the environment is cold enough, the spray ice barrier could survive the summer and serve as a multiyear barrier. This would be advantageous for the protection of relatively permanent structures such as offshore production platforms. If necessary, multiyear spray ice barriers can be maintained by periodically spraying additional water to accumulate more ice whenever the ambient air is below the freezing temperature of the surrounding water.

Whether water is being sprayed from the spray monitors for original construction or for maintenance of a spray ice barrier, some of the water will not freeze before falling to the surface. During the winter, the water in the Beaufort Sea beneath the ice sheet is acutally at its freezing temperature of about 28° F., yet remains unfrozen because cooling is required to absorb the latent heat of fusion. Spraying the sea water through the frigid ambient air provides the necessary cooling. As the droplets travel through the air and freeze, salt ions in the water are locally expelled from the sites of ice crystal formation. This results in the formation of ice having a relatively low concentration of salt, and brine having a salt concentration greater than that of the original sea water and a temperature below the freezing temperature of the original sea water. The freezing process continues as the droplets travel through the air, converting the water streams from the spray monitors into a mixture of ice and brine which falls to the surface.

While it might seem to be a disadvantage that all of the sprayed water does not freeze before impact, a number of important benefits actually result. The mixture of ice and brine will behave more like wet sleet than dry snow. This causes the ice crystals to stick together, thereby forming a stable mass of ice. In addition, the unfrozen brine will percolate downward through the ice crystals which make up the spray ice barrier and will compact the ice crystals. This results in a stronger spray ice barrier. Also, some of the unfrozen brine will run off the sides of the spray ice barrier. This brine has a higher salt concentration and is therefore denser than the sea water, so it will sink toward the bottom along the sloping sides of the spray ice barrier. Since the brine is below the freezing temperature of the sea water, some of the sea water will freeze upon coming into contact with the brine and will add to the mass of the spray ice barrier by building up the underwater slopes with additional ice.

PROTECTING OFFSHORE STRUCTURES FROM WAVE DAMAGE

Spray ice barriers can also serve to protect offshore structures from damage caused by waves. A multiyear spray ice barrier would be especially well suited for this purpose. During the winter when the sea is frozen over, waves are not generated. However, following the breakup of the ice sheet, and throughout the open-water season, waves can pose a serious threat. Two types of offshore structures which face severe wave erosion problems are man-made ice islands and man-made gravel islands.

Man-made ice islands are well known in the art and have been constructed to provide bases upon which to conduct offshore operations such as drilling for oil and gas. Protecting man-made ice islands with spray ice barriers may enable them to survive the entire open-water season and serve as multiyear bases for offshore operations.

Figure 8:
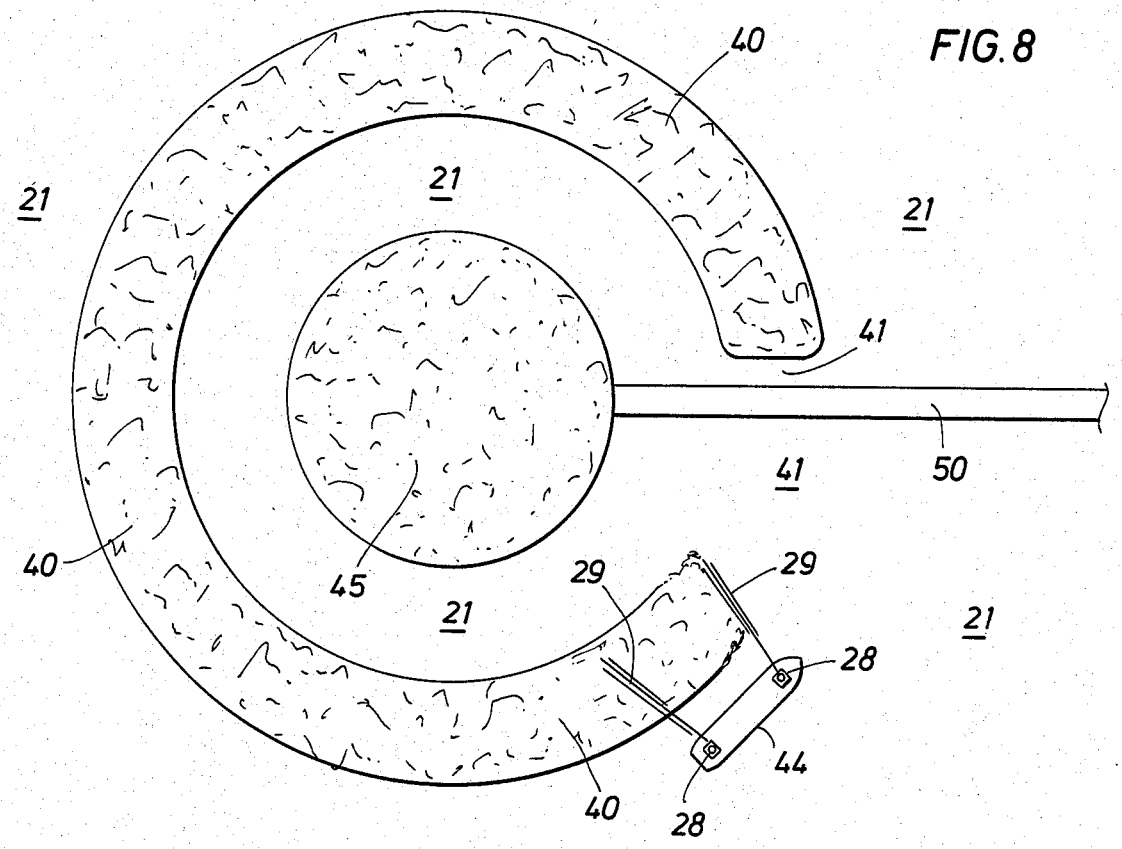
FIG. 8 is a plan view of a spray ice barrier being constructed around a man-made ice island by an icebreaker equipped with spray monitors.

Referring to FIG. 8, icebreaking vessel 44 which is equipped with spray monitors 28 can be seen in the process of constructinhg spray ice barrier 40 around man-made ice island 45. A portion of the side facing shore is left open to provide passageway 41. This side is choosen for the opening because large waves do not threaten from the shoreward side at this location. However, locations which are far from shore may be susceptible to waves from all directions, and at such locations, a 360° spray ice barrier may be desired. Ice sheet 21 and ice road 50 will melt during the summer, but the ice island will be protected from wave erosion by the spray ice barrier. If a multiyear spray ice barrier can be maintained at the location, the ice island may be able to survive year-round and function as a permanent base for offshore operations.

Man-made gravel islands are also well known in the art and have been constructed to serrve as bases for offshore operations in arctic waters. Waves which are present during the open-water season threaten the construction and maintenance of these gravel islands.

Gravel islands can be constructed during the open-water season in relatively deep water by dredging gravel and sand from the sea floor and dumping it at a desired location to build up the island. Constructing the top portion of the gravel island presents the most difficulty. Experience has shown that the gravel island construction process will usually proceed smoothly until the island is built up to a level which is about 20 feet below the surface of the water. As the gravel island rises above this point, large waves will begin to break as they pass through the relatively shallow water overlying the island. The closer the gravel island is to the surface, the greater the wave breaking action. These breaking waves can wreak havoc with construction operations and can quickly erode the gravel island. In the absence of waves, construction of the gravel island could proceed smoothly to completion.

Following completion of the gravel island, waves still pose a threat. As waves break against the slopes of the completed gravel island, gravel is dislodged and carried away, and an unprotected gravel island will eventually be destroyed by this action. A number of methods for protecting the slopes of gravel islands from wave erosion have been tried. One slope protection method is to place large sandbags on the sides of the gravel island. Another method is to reinforce the sides with large concrete mats. Methods such as these have thus far proved to be feasible but expensive, and it is difficult to install slope protection measures during periods of significant wave action. Installation of such slope protection measures can be greatly facilitated by first constructing a spray ice barrier. This will provide a protected enclosure, free of waves, for the installation to be carried out.

Under some circumstances, a spray ice barrier alone may suffice to protect the gravel island. If the environment is cold enough for maintenance of a multiyear spray ice barrier, no other slope protection measures may be required. Also, if the island is to be used only temporarily, as in the case of gravel islands built for exploration drilling, then the spray ice barrier could provide all the protection needed.

Figure 9:
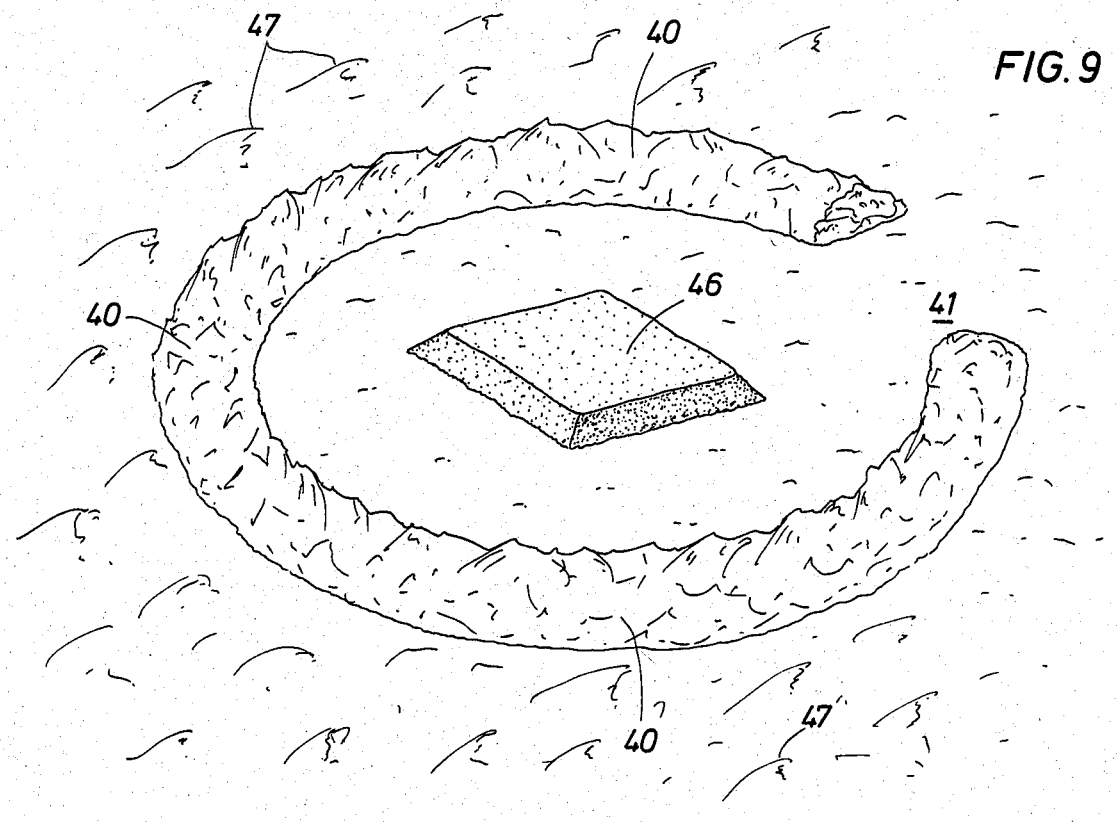
FIG. 9 is a perspective view of a spray ice barrier protecting a man-made gravel island from wave erosion.

Referring to FIG. 9, a spray ice barrier can be seen providing protection for a gravel island during the open-water season. Gravel island 46 is substantially surrounded by spray ice barrier 40. Waves do not approach from the shoreward side at the chosen location, so an opening has been left which faces the shore and provides passageway 41. The spray ice barrier prevents large waves 47 from impacting against the gravel island.

By using the spray ice barrier construction method of the present invention, gravel islands can be protected from wave erosion both during and after their construction. For example, a gravel island located in water about sixty feet deep could be constructed over a two-year period, as follows. During the summer of the first year, with open-water conditions prevailing, dredging operations are commenced and the island is built up to a level which is about 20 feet below the surface. The dredging equipment is then taken elsewhere and construction is halted until the sea freezes over with a sheet of ice. After the ice sheet has formed, an icebreaking vessel equipped with spray monitors is sent to the site to construct a large spray ice barrier around the still submerged gravel island. Following breakup of the ice sheet in the summer of the second year, the dredging equipment is returned and dredging operations are resumed. The top portion of the gravel island is constructed under the calm conditions within the spray ice barrier enclosure. If slope protection measures such as concrete mats are desired, they can be readily installed without interference from waves.

STABILIZING LARGE AREAS OF A MOBILE ICE SHEET

The spray ice barriers and construction method of the present invention can also be used for the protection of long offshore structures such as ice roads. Where protection is needed over a long distance, a number of discontinuous spray ice barriers, spaced apart, may be preferable to a single barrier. Each of the discontinuous spray ice barriers locally grounds the ice sheet. By having a number of spray ice barriers at spaced-apart locations, the entire area can be stabilized to prevent ice movement. Referring to FIG. 10, an example of such a spray ice barrier arrangement can be seen. Offshore production platform 47 is located relatively far from the shore (not shown) in arctic waters covered by ice sheet 21. Spray monitor 28 is mounted on the platform and can be seen in the process of completing circular-shaped spray ice barrier 40 which substantially surrounds the platform and protects it. Passageway 41 has been left for an ice road. An ice road which stretches the distance between the offshore production platform and the shore is to be constructed along the path shown by dotted lines 49. At this location, the motion of the ice sheet and large bodies of ice embedded within it would threaten the ice road along almost its entire length.

Discontinuous spray ice barriers **40*c* which protect the ice road on both sides are constructed by icebreaker 44 which is equipped with two spray monitors 28**. The numerous discontinuous spray ice barriers can be constructed very rapidly using a number of such icebreakers. By constructing these spray ice barriers along both sides of the ice road path at locations spaced apart by about 1/10 mile to 2 miles, the ice sheet wll be stabilized. The optimum spacing distance will depend upon a number of factors, foremost of which is the water's depth. In general, the deeper the water, the closer the spray ice barriers will need to be.

Once the ice sheet is stabilized by the spray ice barriers, the ice road can be constructed without the destructive threat posed by movement of the ice sheet. When the ice sheet is thin, it is especially subject to movement, and such movement can crack the ice road. If not for the protection afforded by the spray ice barriers, it would be necessary to wait until the ice sheet becomes quite thick before ice road construction could begin. Stabilizing the ice sheet with numerous discontinuous spray ice barriers enables ice road construction to be commenced much sooner. Following the ice road's completion, the spray ice barriers will continue to provide protection throughout the ice road's useful life from damage which would otherwise be caused by mobile ice.

Discontinuous spray ice barriers such as those described for the protection of ice roads can also be used to stabilize very large offshore areas. Referring to FIG. 11, a spray ice barrier arrangement for protecting structures in an oil field which is outlined by dotted lines 52 can be seen. There are two production platforms 47 and two drilling platforms 48 working the field, which is some distance from shore 53. Ice roads 50 lead from these platforms to the shore. Discontinuous spray ice barriers **40*c* have been constructed along the exposed seaward side of the field. By grounding ice sheet 21**, ice movements within the entire field area are prevented. The area of the ice sheet which lies between the oil field and the shore will also be stabilized. The production and drilling platforms and the ice roads are thus afforded common protection by the discontinuous spray ice barriers.

Having described the spray ice barriers and construction method of the present invention, the description now turns to devices which may be used to rapidly construct these spray ice barriers.

DEVICES FOR CONSTRUCTING SPRAY ICE BARRIERS

Referring again to FIG. 1, spray monitors 28 which can be used to construct the spray ice barriers of the present invention are seen to be components of water spray modules 60, which in this case are located at each corner of drilling barge 20. The water spray modules are self-contained units which comprise the equipment used to conduct the water spray operations. These water spray modules are portable and can be readily replaced in the event of failure or deployed elsewhere when they are no longer needed on the drilling barge.

Figure 12:
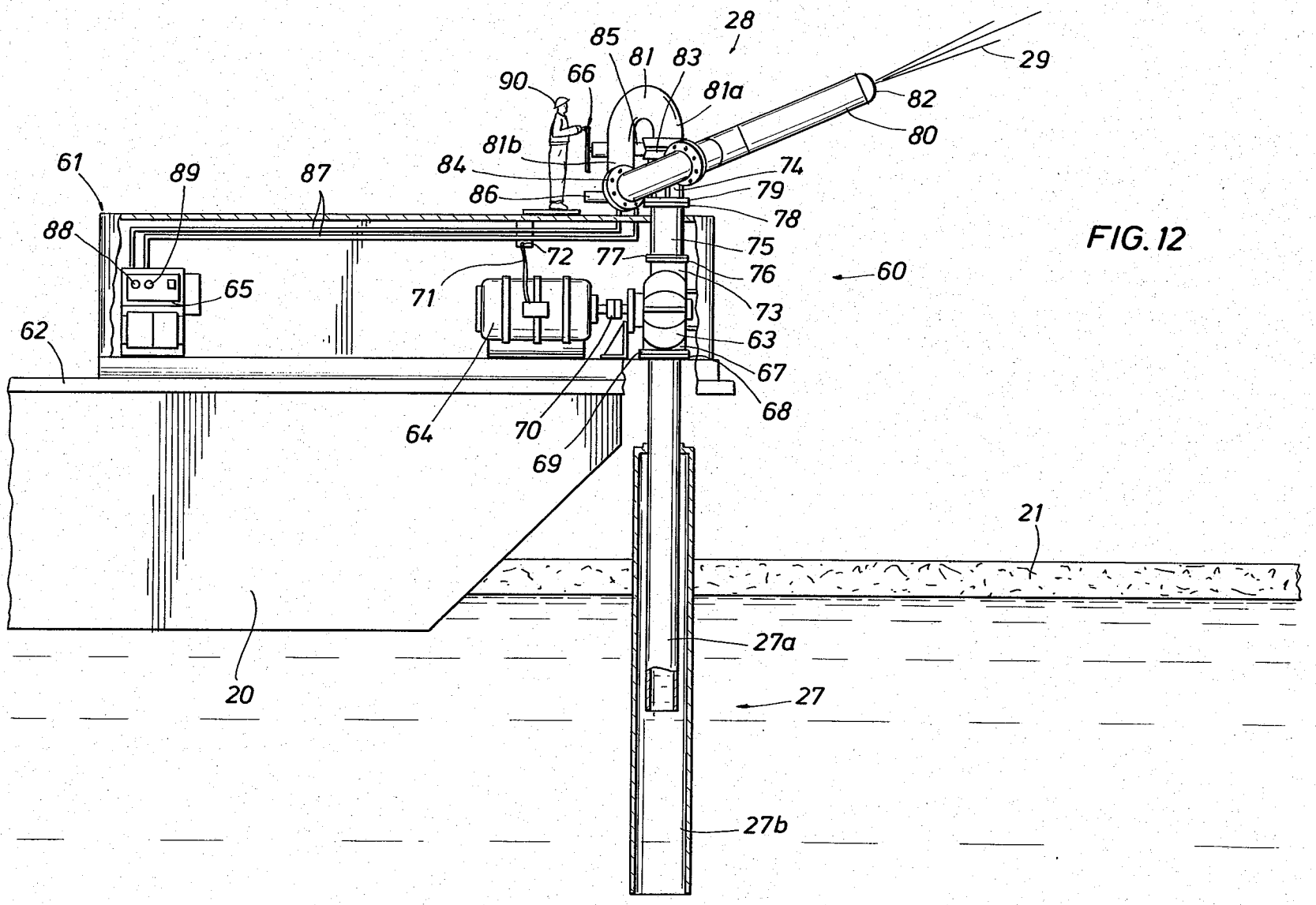
FIG. 12 is a side view, partly in section, showing a water spray module which can be used to construct spray ice barriers.

Referring to FIG. 12, the details of a water spray module can be seen in a side view which is partly in section. The water spray module comprises enclosure 61, skid 62, roof-mounted spray monitor 28, suction line 27, pump 63, electric motor 64, remote hydraulic control system 65 and manual control system 66.

The water spray module is cantilevered on the deck of drilling barge 20 so that suction line 27 can extend straight down into the sea water. An alternative arrangement (not shown) would be to have a channel extending from the deck of the drilling barge through the bottom of its hull to accommodate the suction line. The suction line extends through an opening in ice sheet 21 to a position well beneath the ice sheet and well above the bottom. This position permits clean water to be drawn through the suction line by avoiding the sediments of the bottom (not shown) and the ice pieces and other debris (not shown) which can accumulate under the ice sheet.

The suction line is equipped with telescoping means (not shown) which permits the suction line to be lowered to the desired position and retrieved when necessary. The suction line comprises inner suction pipe 27a which is surrounded by insulated casing 27b. When fully extended, the suction line reaches approximately 20 feet below the surface of the ice sheet.

Water flows from the suction line to pump 63 via pump intake 67. The suction line terminates at its upper end with suction line flange 68 which is detachably connected to pump intake flange 69 in a watertight fashion. Water is drawn through the suction line by pump 63 which is attached to the floor of enclosure 61. The pump is a bottom feed, vertical discharge centrifugal pump which is turned by pump drive shaft 70. All pump components which contact the pumped sea water are fabricated from materials resistant to the corrosion and cavitation erosion associated with pumping sea water. A pump which is suitable for use in the present invention is pump model number 52 BB 18-21 available from Thune-Eureka A/S of Tranby, Norway.

The pump drive shaft is turned by electric motor 64 which is supplied with electricity from generators (not shown) that are located on the deck of the drilling barge. Electrical cable 71 runs from the electric motor through electrical cable port 72 to the generators.

Water exiting the pump flows from pump outlet 73 to spray monitor intake 74 via pipe 75. The pump outlet terminates at its upper end with pump outlet flange 76 which is attached to pipe lower flange 77 in a watertight fashion. Pipe upper flange 78 is detachably connected to spray monitor intake flange 79 in a watertight fashion.

Water flows from the spray monitor intake to spray monitor barrel 80 through curved conduit 81 and exits as water stream 29 from spray monitor nozzle 82. The curved conduit has a first end 81a that connects to horizontal sweep swivel 83 and a second end 81b that connects to vertical sweep swivel 84.

The horizontal sweep swivel is watertight and permits the spray monitor barrel to be pivoted in the horizontal plane through an arc of about 270 degrees. The vertical elevation swivel is also watertight and permits the spray monitor barrel to be pivoted in the vertical plane and aimed at an angle of elevation anywhere from about 25 degrees below horizontal to about 70 degrees above horizontal. These two swivels permit the spray monitor barrel to be pointed in a wide range of directions for the construction of spray ice barriers of desired dimensions where they are needed. All swivel seals and other elastomeric components of the spray monitor are fabricated from materials having a service temperature of −40 degrees Fahrenheit or less. A spray monitor suitable for use in the present invention is the model number EF 400 available from Thune-Eureka A/S of Tranby, Norway.

There are two independent systems for pivoting the spray monitor barrel on the swivels, a motorized hydraulic system and a manual system. The motorized hydraulic system comprises hydraulic horizontal sweep motor 85, hydraulic vertical elevation motor 86, hydraulic lines 87 and remote hydraulic control system 65. The hydraulic horizontal sweep motor pivots the spray monitor barrel horizontally on the horizontal sweep swivel. The hydraulic vertical elevation motor pivots the spray monitor barrel vertically on the vertical elevation swivel.

The hydraulic lines run from the hydraulic horizontal sweep motor and the hydraulic vertical elevation motor through the enclosure to the remote hydraulic control system which is located inside. A remote hydraulic control system which can be used is the model number DB-25956 available from Thune-Eureka A/S of Tranby, Norway. The remote hydraulic control system has automatic horizontal sweep control 88 which permits the spray monitor barrel to be automatically swept back and forth through a desired horizontal arc. The remote hydraulic control system also has automatic vertical elevation control 89 which permits the spray monitor barrel to be automatically swept up and down through a desired vertical arc. The spray monitor can thus automatically construct a spray ice barrier of desired dimensions, eliminating the need for an operator to be in constant control. However, manual control may at times be desired, such as in the event of a failure of the remote hydraulic control system, so manual control system 66 is located on the spray monitor and permits operator 90 to aim the water stream by hand from the roof of the enclosure.

The enclosure has a floor, four walls and a roof, which are all fabricated from welded structural steel. The walls and roof are insulated with 4 inch thick fire resistant insulation (not shown). The enclosure has a heating system (not shown) for maintaining the interior at a temperature above that of the frigid ambient environment. The spray monitor is detachably mounted on the roof of the enclosure, and the enclosure is detachably mounted on skid 62. The skid is adapted so that the entire water spray module can be conveniently handled and moved about by a crane, forklift or winch truck. Suitable cabling eyes and other means of attachment (not shown) are provided for securely fastening the water spray module to the deck of the drilling barge. When necessary, such as for shipment of the water spray module, the suction line and the roof-mounted spray monitor can be detached and stowed inside the enclosure.

As in the case of the drilling barge shown in FIG. 1, water spray modules can be deployed on the offshore structure for which protection is desired. Another example of this would be the deployment of a water spray module on an offshore platform to construct a spray ice barrier around it. An example of such an arrangement can be seen in FIG. 10. However, the water spray operations do not have to be conducted from the structure for which protection is sought. For example, the water spray operations can be conducted from a support vessel such as an icebreaker. After finishing the construction of one spray ice barrier, the icebreaker can be dispatched to another location where a spray ice barrier is needed.

Referring again to FIG. 10, icebreaker 44 which is equipped with two spray monitors 28 can be seen. The icebreaker is adapted for breaking through ice sheet 21. In the case shown in this figure, the icebreaker has been deployed to construct discontinuous spray ice barriers 40c along a proposed ice road path shown by dotted lines 49. When the icebreaker reaches the desired location, suction lines (not shown) are lowered into the water through openings in the ice sheet which have resulted from passage of the icebreaker. If necessary, crane 23 can assist in clearing the ice to make an opening for the suction lines.

Once the suction lines are in place, electric motors (not shown) are turned on and water is pumped through spray monitors 28. The spray monitors are oscillated horizontally and vertically by a remote hydraulic control system (not shown) in order to construct a first spray ice barrier.

After a sufficient mass of ice has been built up to complete the first spray ice barrier, the suction lines are raised and the icebreaker moves to a second position from which it can construct a second spray ice barrier at a location spaced apart from the first spray ice barrier. The suction lines are again lowered, spraying is commenced, and a second spray ice barrier is constructed. This procedure is repeated until the entire ice road path is protected by a number of discontinuous spray ice barriers.

Figure 13:
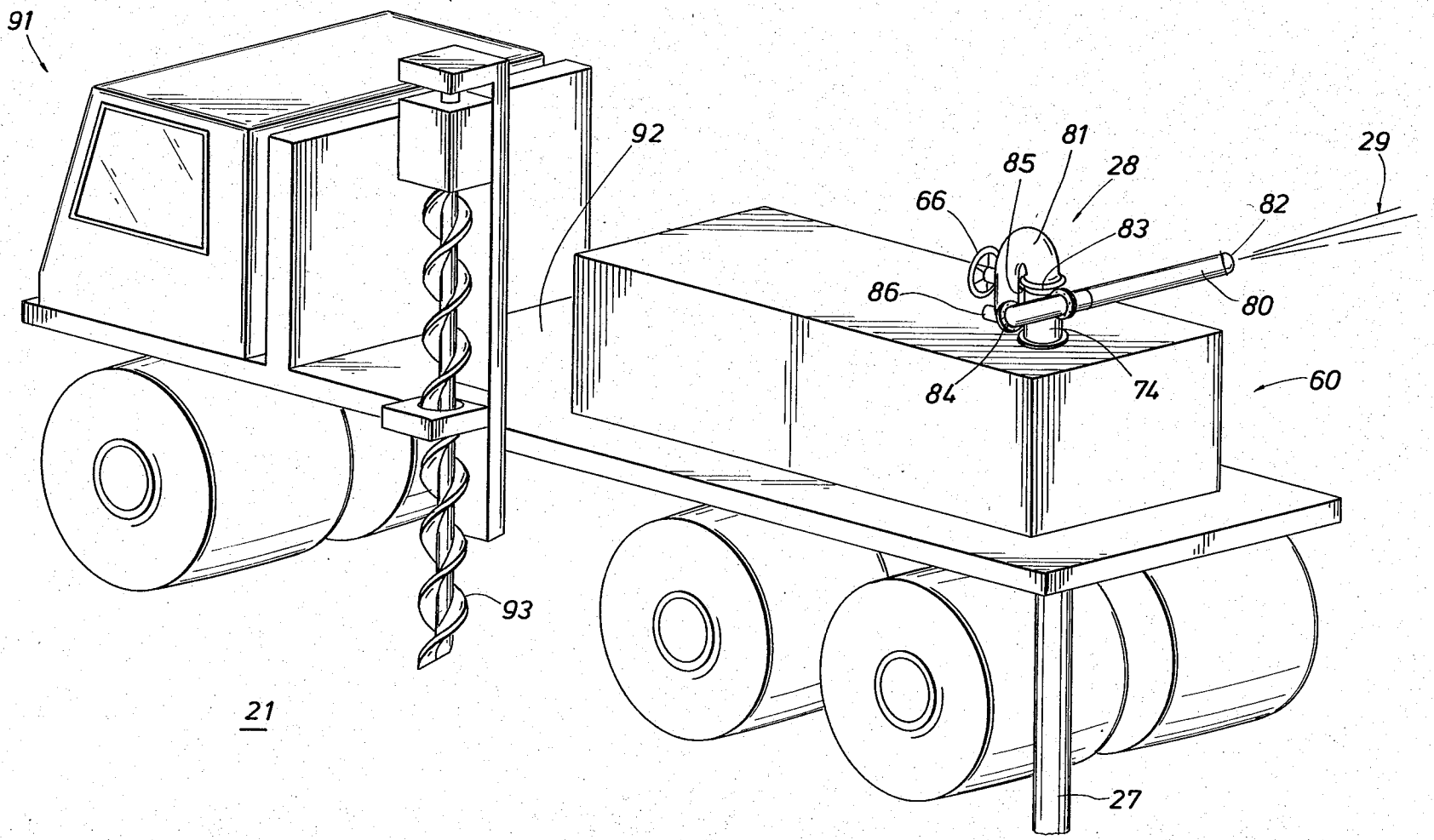
FIG. 13 is a perspective view of a vehicle equipped with a water spray module and an ice auger.

Vehicles which are equipped with water spray modules and which can travel over ice can also be used to build spray ice barriers. Referring to FIG. 13, a vehicle adapted for this purpose can be seen. Truck 91 is in the process of constructing a spray ice barrier (not shown). Water spray module 60 is secured to bed 92 of the truck, and suction line 27 extends through a hole in ice sheet 21. This hole was made by ice auger 93 which is attached to the truck and is adapted for extending downward a sufficient distance to bore through the ice sheet. With the suction line in place, spraying is conducted and spray monitor 28 is aimed to construct the spray ice barrier.

If a very large spray ice barrier is needed, it may have to be constructed in sections. In such a case, when the first section of the spray ice barrier is completed, the suction line is raised until it clears the ice sheet. The truck is then driven to an adjacent second location and another hole is bored through the ice sheet with the ice auger. The truck is then moved to align the suction line with the hole, and the suction line is extended downward into the water. Spraying is resumed and a second section of the spray ice barrier is constructed adjacent to the first section. As the second section is built up, it melds into the first section, forming a single spray ice barrier. This procedure is repeated until the entire spray ice barrier has been built.

Vessels and vehicles equipped with spray monitors can not only construct spray ice barriers very rapidly, they can serve other purposes as well. For example, the high output capacity of the spray monitors makes them well suited for such other applications as fire fighting and well killing.

Inasmuch as the present invention is subject to many variations, modifications and changes in detail, it is intended that all subject matter discussed above or shown in the accompanying drawings be interpreted as illustrative and not in a limiting sense. Such modifications and variations are included within the scope of this invention as defined by the following claims.

What is claimed is:

1. A method for protecting an offshore structure located in a body of water which is at or near its freezing temperature, comprising the steps of:

(a) withdrawing water from said body of water when the temperature of the ambient air is below the freezing temperature of said water;

(b) spraying said water upwardly and outwardly in a stream through said ambient air to cause said water to freeze as it passes through said ambient air, said stream being directed so that the resulting spray ice is deposited at a location which is laterally offset from said offshore structure and from the position from which said water is sprayed, wherein said spraying causes a high enough percentage of said water to freeze as it passes through said ambient air so that the resulting spray ice accumulates into a mass of spray ice at said location; and (c) continuing steps (a) and (b) until said mass of spray ice forms a grounded spray ice barrier having a size and shape adapted to protect said offshore structure.

2. The method of claim 1 wherein the maximum height of said stream is varied during step (b).

3. The method of claim 1 wherein the horizontal direction of said stream is varied during step (b).

4. The method of claim 1 wherein said stream is oscillated horizontally during step (b).

5. The method of claim 1 wherein said stream is oscillated vertically during step (b).

6. The method of claim 1 wherein said stream is oscillated horizontally and vertically during step (b).

7. The method of claim 1 wherein steps (a), (b) and (c) are performed at a time when said body of water is at least partially covered by a naturally occuring ice sheet.

8. The method of claim 1 wherein steps (a) and (b) are continued until said grounded spray ice barrier at least partially surrounds said offshore structure.

9. The method of claim 1 wherein steps (a) and (b) are continued until said grounded spray ice barrier completely surrounds said offshore structure.

10. The method of claim 1 wherein steps (a), (b) and (c) are performed from said offshore structure.

11. The method of claim 1 wherein steps (a), (b) and (c) are performed to protect an offshore platform.

12. The method of claim 1 wherein steps (a), (b) and (c) are performed to protect an offshore ice road.

13. The method of claim 1 wherein steps (a), (b) and (c) are performed to protect a man-made island.

14. A method for protecting a drilling vessel at an offshore site in a body of water which is at or near its freezing temperature, comprising the steps of:

(a) withdrawing water from said body of water when the temperature of the ambient air is below the freezing temperature of said water;

(b) spraying said water upwardly and outwardly in a stream through said ambient air to cause said water to freeze as it passes through said ambient air, said stream being directed so that the resulting spray ice is deposited at a location which is laterally offset from said drilling vessel and from the position from which said water is sprayed, wherein said spraying causes a high enough percentage of said water to freeze as it passes through said ambient air so that the resulting spray ice accumulates into a mass of spray ice at said location, and (c) continuing steps (a) and (b) until said mass of spray ice forms a grounded spray ice barrier having a size and shape adapted to protect said drilling vessel.

15. The method of claim 14 wherein the maximum height of said stream is varied during step (b).

16. The method of claim 14 wherein the horizontal direction of said stream is varied during step (b).

17. The method of claim 14 wherein said stream is oscillated horizontally during step (b).

18. The method of claim 14 wherein said stream is oscillated vertically during step (b).

19. The method of claim 14 wherein said stream is oscillated horizontally and vertically during step (b).

20. The method of claim 14 wherein steps (a), (b) and (c) are performed at a time when said body of water is at least partially covered by a naturally occurring ice sheet.

21. The method of claim 14 wherein steps (a) and (b) are continued until said grounded spray ice barrier at least partially surrounds said drilling vessel.

22. The method of claim 14 wherein steps (a) and (b) are continued until said grounded spray ice barrier completely surrounds said drilling vessel.

23. The method of claim 14 wherein steps (a), (b) and (c) are performed before said drilling vessel is transported to said offshore site.

24. The method of claim 14 wherein steps (a), (b) and (c) are performed after said drilling vessel has been transported to said offshore site.

25. The method of claim 14 wherein steps (a), (b) and (c) are performed from said drilling vessel.

26. A method for stabilizing an area of a naturally occurring ice sheet on a body of water which is at or near its freezing temperature, comprising the steps of:

(a) withdrawing water from said body of water when the temperature of the ambient air is below the freezing temperature of said water;

(b) spraying said water upwardly and outwardly in a stream through said ambient air to cause said water to freeze as it passes through said ambient air, said stream being directed so that the resulting spray ice is deposited at a location which is laterally offset from the position from which said water is sprayed, wherein said spraying causes a high enough percentage of said water to freeze as it passes through said ambient air so that the resulting spray ice accumulates into a mass of spray ice at said location;

(c) continuing steps (a) and (b) until said mass of spray ice forms a grounded spray ice barrier; and (d) repeating steps (a), (b) and (c) to form a plurality of grounded spray ice barriers, said grounded spray ice barriers being sufficiently close together to stabilize said area of said naturally occurring ice sheet.

27. A method for protecting a body of water which is at or near its freezing temperature from a floating pollutant spill, comprising the steps of:

(a) withdrawing water from said body of water when the temperature of the ambient air is below the freezing temperature of said water;

(b) spraying said water upwardly and outwardly in a stream through said ambient air to cause said water to freeze as it passes through said ambient air, said stream being directed so that the resulting spray ice is deposited at a location which is laterally offset from the position from which said water is sprayed, wherein said spraying causes a high enough percentage of said water to freeze as it passes through said ambient air so that the resulting spray ice accumulates into a mass of spray ice at said location; and (c) continuing steps (a) and (b) until said mass of spray ice forms a spray ice barrier having a size and shape adapted to contain said pollutant spill.

28. The method of claim 27 wherein steps (a), (b) and (c) are performed at a time when said body of water is at least partially covered by a naturally occurring ice sheet.

* * * * *

REEXAMINATION CERTIFICATE (655th)

United States Patent [19]

Finucane et al.

[11] B1 4,523,879

[45] Certificate Issued Mar. 24, 1987

[54] ICE BARRIER CONSTRUCTION

[75] Inventors: Raymond G. Finucane; Hans O. Jahns, both of Houston, Tex.

[73] Assignee: Exxon Production Research Co., Houston, Tex.

Reexamination Request:
No. 90/001,020, Jun. 2, 1986

Reexamination Certificate for:

| | |
|---|---|
| Patent No.: | **4,523,879** |
| Issued: | **Jun. 18, 1985** |
| Appl. No.: | **369,042** |
| Filed: | **Apr. 16, 1982** |

[51] Int. Cl.[4] ..... E02D 21/00; E02B 17/00

[52] U.S. Cl. ..... 405/217; 62/260; 405/60; 405/195

[58] Field of Search ..... 405/52, 60, 61, 211, 405/217; 62/259, 260

[56] References Cited

U.S. PATENT DOCUMENTS 3,750,412 8/1973 Fitch et al. ..... 405/217

OTHER PUBLICATIONS

Article entitled "Artificial Ice Islands Could Cut Arctic Costs", by Fitch et al., from The Oil and Gas Journal, Nov. 11, 1974, pp. 173-181.

*Primary Examiner*—Dennis L. Taylor

[57] ABSTRACT

A method is provided for constructing spray ice barriers to protect offshore structures in a frigid body of water from mobile ice, waves and currents. Water is withdrawn from the body of water and is sprayed through ambient air which is below the freezing temperature of the water so that a substantial amount of the water freezes as it passes through the air. The sprayed water is directed to build up a mass of ice having a size and shape adapted to protect the offshore structure. Spray ice barriers can also be constructed for the containment of pollutant spills.

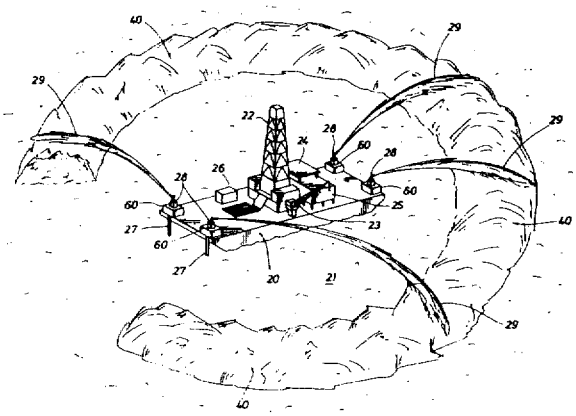

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–28 is confirmed.

* * * * *